US007195218B2

(12) United States Patent
James et al.

(10) Patent No.: US 7,195,218 B2
(45) Date of Patent: Mar. 27, 2007

(54) ROD HANGER ADAPTER

(75) Inventors: Gary W. James, Parma Heights, OH (US); Gary R. Kish, Parma, OH (US); Bernard J. Golias, Jr., Twinsburg, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 0 days.

(21) Appl. No.: 10/812,221

(22) Filed: Mar. 29, 2004

(65) Prior Publication Data

US 2004/0256527 A1 Dec. 23, 2004

Related U.S. Application Data

(60) Provisional application No. 60/458,634, filed on Mar. 28, 2003.

(51) Int. Cl.
*A47H 1/14* (2006.01)

(52) U.S. Cl. ..... 248/251; 248/262; 248/300

(58) Field of Classification Search ..... 248/251, 248/200, 300, 261, 262, 343
See application file for complete search history.

(56) References Cited

U.S. PATENT DOCUMENTS

| | | | | | |
|---|---|---|---|---|---|
| 3,894,377 | A * | 7/1975 | Welch | 52/584.1 |
| 4,460,147 | A * | 7/1984 | Macbain | 248/542 |
| 4,470,716 | A * | 9/1984 | Welch | 403/254 |
| 4,473,316 | A * | 9/1984 | Welch | 403/246 |
| 5,502,942 | A * | 4/1996 | Gras et al. | 52/511 |
| 5,678,797 | A * | 10/1997 | Gogan | 248/251 |
| 6,109,819 | A * | 8/2000 | Welch | 403/353 |
| 6,213,437 | B1 * | 4/2001 | Robbins | 248/261 |
| 2005/0025603 | A1 * | 2/2005 | Hullman et al. | 411/111 |

* cited by examiner

*Primary Examiner*—Amy J. Sterling
(74) *Attorney, Agent, or Firm*—Fay Sharpe LLP

(57) ABSTRACT

A rod hanger adapter selectively mounted to an associated cabinet includes a first wall comprising an opening for mounting the rod hanger adapter to a wall of the associated cabinet and a second wall connected to, spaced from and at least substantially parallel to the first wall. The second wall includes a slot for receiving an associated rod.

6 Claims, 4 Drawing Sheets

ROD HANGER ADAPTER

This application claims the benefit of U.S. Provisional Application No. 60/458,634 filed Mar. 28, 2003, which is incorporated by reference.

BACKGROUND OF THE INVENTION

The present invention relates to removable components for a cabinet such as a metal cabinet. More particularly, the invention is related to a component that can be removably mounted to a side wall of a cabinet to receive a rod on which items can be hung.

Metal cabinets are some of the most versatile pieces of furniture available. Metal cabinets can be hung in work areas, e.g., metal or woodworking shops, garages, as well as many other places. Metal cabinets can also provide storage in vehicles such as trucks and vans. In addition to the versatility provided by metal cabinets regarding the location and placement of the cabinets, metal cabinets also provide versatility in what they store. Metal cabinets have been used to store threaded rod, wire, brake line, welding rods, as well as more common items such as tools and fasteners. To increase a metal cabinet's versatility, some of the shelves are removable so that larger or different items can be stored in the cabinet. For the shelves to be removable, they are mounted to lances that are mounted to or punched out of or otherwise formed in the side walls of a cabinet.

It is desirable that metal cabinets with lances be able to accommodate rods so that items may be hung from the rods. Prior art cabinets typically have rod hangers welded to the inside of the cabinet. Such rod hangers were therefore not removable by the owner or user of the cabinet. Accordingly it is desirable to have a rod hanger that is easily mountable and removable from a metal cabinet.

SUMMARY OF THE INVENTION

In accordance with one aspect of the invention, a rod hanger adapter is selectively mounted to an associated cabinet and includes a first wall having an opening for mounting the rod hanger adapter to a wall of the associated cabinet and a second wall spaced from and substantially parallel to the first wall. The second wall includes a slot for receiving an associated rod.

In accordance with another aspect of the invention, a method for selectively hanging a rod in a cabinet wherein the cabinet includes lances on side walls thereof includes the following steps: mounting a first rod hanger adapter having an opening in a wall of the adapter to a first side wall of the cabinet by placing one of the lances through the opening such that the first rod hanger adapter hangs from the lance, mounting a second rod hanger adapter having an opening in a wall of the second adapter to a second side wall of the cabinet by placing another one of the lances through the opening such that the second rod hanger adapter hangs from the lance, and placing a rod in a slot of each of the first rod hanger adapter and the second rod hanger adapter. The slots are aligned along the same longitudinal axis.

In accordance with yet another aspect of the invention, a rod hanger adapter for selective mounting to a cabinet has five walls wherein a first wall includes an opening for mounting the rod hanger adapter to a wall of an associated cabinet. A second wall is spaced from and at least substantially parallel to the first wall. The second wall includes a slot for receiving an associated rod. A third wall is spaced from and at least substantially parallel to the second wall. A fourth wall interconnects the first wall to the second wall. The slot in the second wall extends into the fourth wall. A fifth wall interconnects the second wall to the third wall.

Still other aspects of the invention will become apparent to those skilled in the art upon reading and understanding the following detailed description.

BRIEF DESCRIPTION OF THE DRAWINGS

The invention takes form in certain parts and arrangements of parts, preferred embodiments of which will be described in detail in this specification and illustrated in the accompanying drawing which form a part hereof and wherein.

DETAILED DESCRIPTION OF THE EMBODIMENTS

While this invention may have embodiments in many different forms, there are shown in drawings and will described in detail herein specific embodiments thereof with the understanding that the description is to be considered as an exemplification of the principles of the invention and is not intended to limit the invention to the specific embodiments illustrated.

Figure 1:
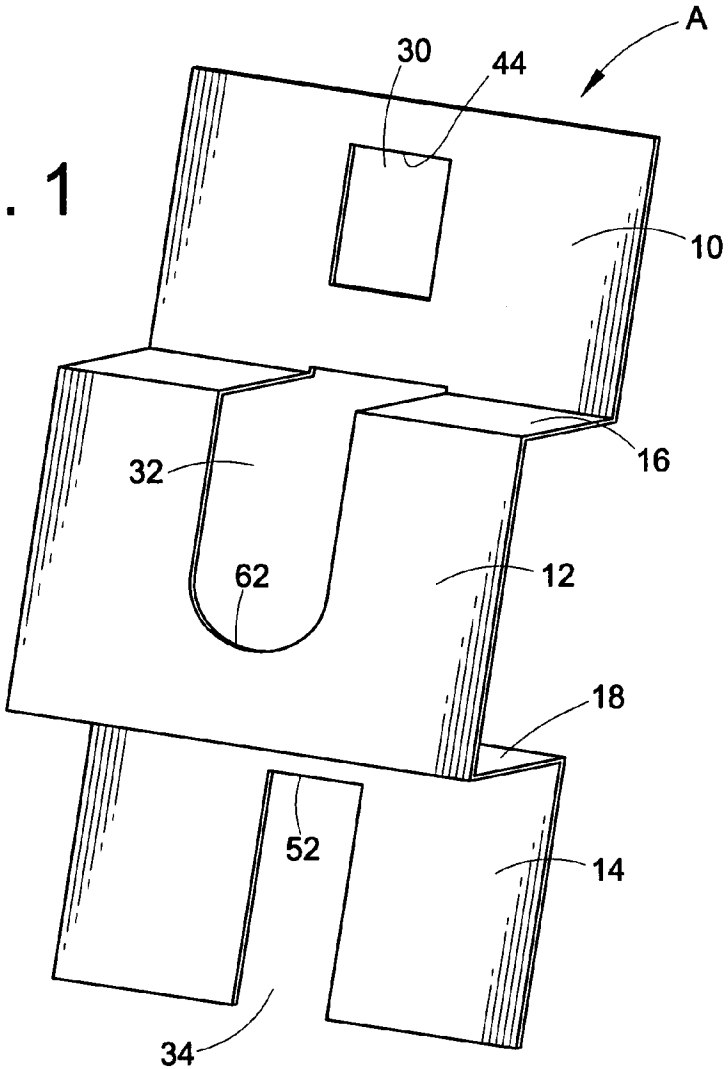
FIG. 1 is a perspective view of a rod hanger adapter in accordance with a first embodiment of the present invention.

In accordance with one embodiment of the invention, FIG. 1 discloses a rod hanger adapter A that can be made from metal, preferably steel, although other materials can be used without departing from the scope of the invention. The rod hanger adapter A includes first, second and third walls 10, 12, 14 which are substantially parallel to each other. The rod hanger adapter A also includes a fourth wall 16 interconnecting first and second walls 10, 12 and a fifth wall 18 interconnecting the second wall 12 and the third wall 14. Wall 16 and wall 18 are substantially parallel to each other and are spaced apart from each other. Furthermore, walls 16, 18 are substantially perpendicular to walls 10, 12, 14. Wall 12 is spaced from and is substantially parallel to walls 10, 14. When the adapter is installed onto a cabinet wall, walls 10, 12, 14 hang in a vertical direction and walls 16, 18 hang in a perpendicular or horizontal direction.

Figure 2:
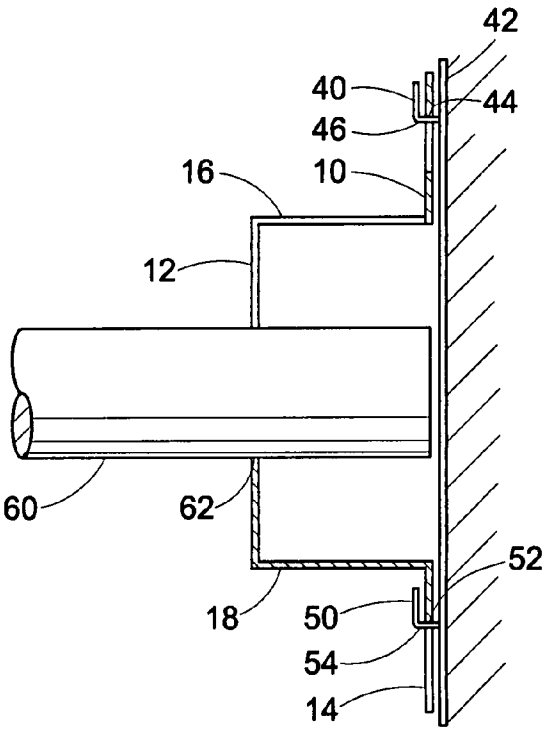
FIG. 2 is a side elevational view in cross-section of the rod hanger adapter of FIG. 1 mounted to a side wall of a cabinet.

As seen in FIGS. 1 and 2, wall 10 includes an opening 30 which can be square or rectangular and is shaped and positioned to receive a lance 40 that extends from or is mounted to a cabinet wall 42. Other shapes of the opening can be used without departing from the scope of the invention. The opening has an edge 44 that is received by a bottom leg 46 of the lance 40 when the rod hanger adapter A is mounted to the cabinet wall. Opening 30 is shown to be located centrally on the wall 10. However, the opening may be positioned off-center on the wall as well.

Third wall 14 defines a notch 34 on the wall which is substantially rectangular in shape. Notch 34 is configured to receive a lance 50 such that an edge 52 of the notch 34 abuts a lower leg 54 of the lance. Typically, opening 30 and notch 34 are aligned with one another along a longitudinal axis of the adapter. Notch 34, which has a substantially U-shaped configuration, does not have a lower edge to allow for easy installation of the adapter over a lower lance in the cabinet wall. Alternately, an opening similar to opening 30 can be used instead of notch 34.

Figure 3:
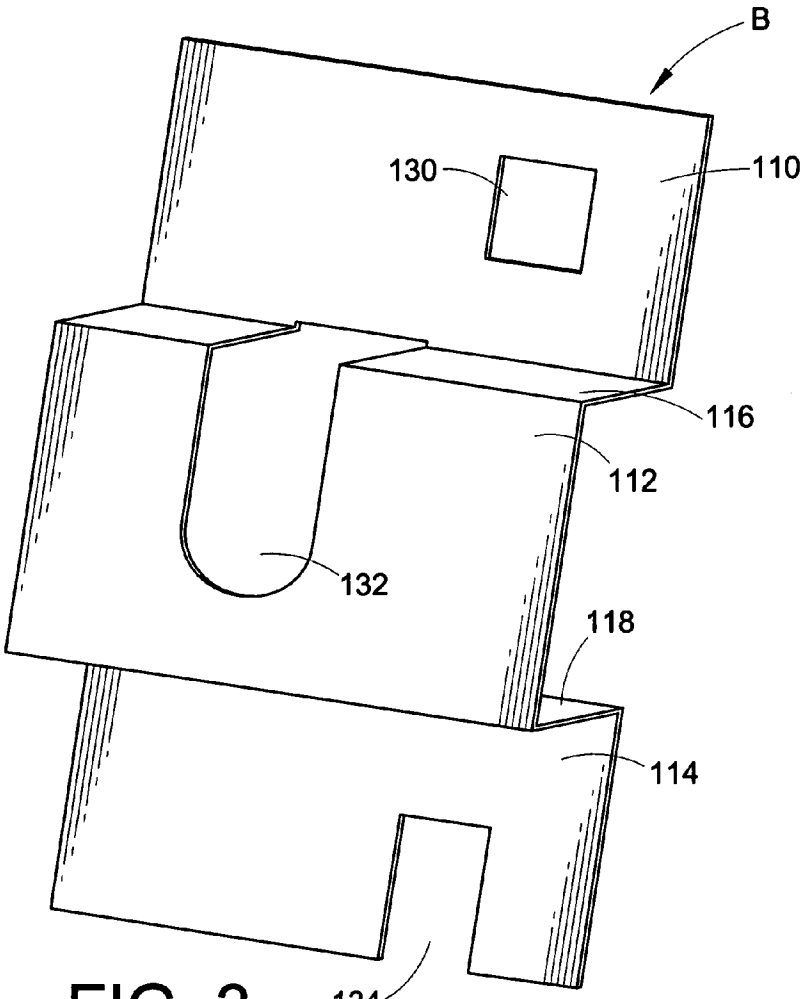
FIG. 3 is a perspective view of a second embodiment of a rod hanger adapter of the present invention.

Referring now to FIG. 2, an L-shaped slot 32 which extends from wall 16 to wall 12 is configured to receive a rod 60. The rod 60 abuts an edge 62 of slot 32. Referring to FIG. 1, the edge 62 is curved to receive a cylindrical rod; however, the edge 62 can have various configurations to receive various shaped rods. For example, edge 62 could be straight to receive a rectangular or square rod. Furthermore, slot 32 is aligned with the opening 30 and notch 34 along a central longitudinal axis of the adapter. However, as seen in FIG. 3, the slot need not be aligned with the opening and the notch.

To attach the rod hanger adapter A to the cabinet wall 42, the adapter is slid over lances 40, 50 such that opening 30 receives lance 40 and notch 34 receives lance 50. The rod hanger adapter is slid downwardly until edge 44 contacts the bottom leg 46 of lance 40 and edge 52 contacts the bottom leg 54 of lance 50. After the rod hanger adapter is attached to the cabinet wall 42, rod 60 is inserted into slot 32 such that a bottom surface of the rod 60 contacts edge 62.

A second rod hanger adapter A is hung from an opposite wall of the cabinet in the same fashion as described above. The opposite end of the rod is placed in the second rod hanger adapter so that the rod is supported between the two adapters. The rod is then securely mounted within the cabinet.

Referring again to FIG. 3, an alternative embodiment of a rod hanger adapter B is shown. The rod hanger adapter includes a first wall 110, a second wall 112, and a third wall 114. Wall 112 is spaced from and parallel to wall 110 and wall 114.

The rod hanger adapter B further includes a fourth wall 116 interconnecting first wall 110 and second wall 112 which is substantially perpendicular to walls 110, 112. A fifth wall 118 interconnects walls 112, 114. Wall 118 is parallel to wall 116 and is substantially perpendicular to walls 112, 114.

Wall 110 includes an opening 130 adapted to receive a lance. The opening may be square, rectangular, or any other shape dependent upon the configuration of the lance that it will receive. Wall 114 includes a notch 134 also adapted to receive a lance. Opening 130 and notch 134 are preferably aligned along a central longitudinal axis of the adapter. However, as shown in FIG. 3, opening 130 and notch 134 need not be aligned along the longitudinal axis of the adapter.

Walls 112, 116 each includes a slot 132 adapted to receive a rod. Slot 132 can be off-center or not aligned with each opening 130 and notch 134. This allows the rod to be placed deeper in the cabinet especially when the lances are located near the opening or front of the cabinet.

Figure 4:
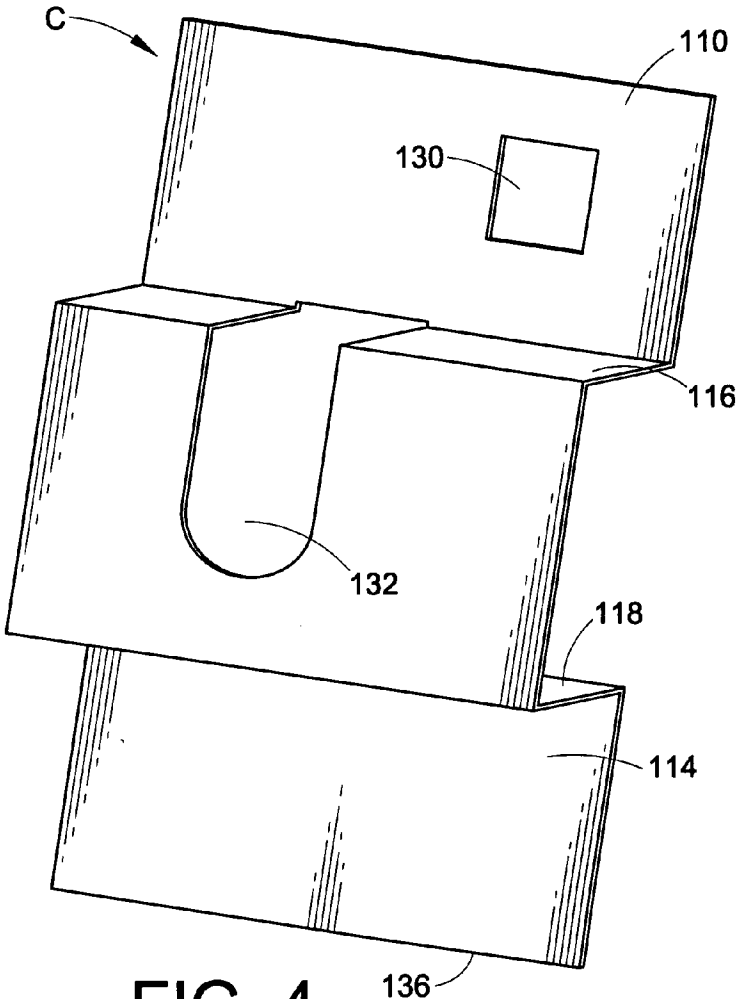
FIG. 4 is a perspective view of a third embodiment of a rod hanger adapter in accordance with the present invention.

FIG. 4 illustrates another embodiment of a rod hanger adapter C similar to the rod hanger adapter of FIGS. 1 and 3. The rod hanger adapter shown in FIG. 4 does not include a notch to receive a lance in the third vertical wall 114. Rod hanger adapter C instead has a lower edge 136 that abuts the bottom surface of the cabinet. This embodiment is especially useful for cabinets having a side wall with only one lance.

Figure 5:
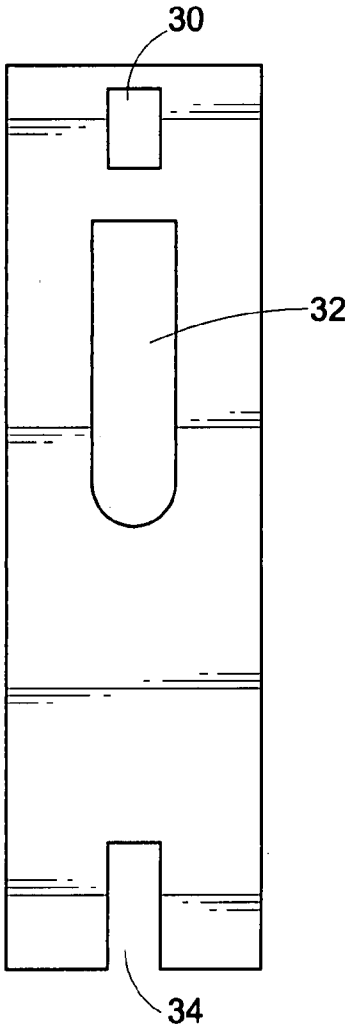
FIG. 5 is a plan view of a blank prior to being formed into the rod hanger adapter of FIG. 1.

FIG. 5 illustrates a metal blank prior to being formed into the rod hanger adapter A of FIG. 1. As can be seen, the rod hanger adapter A can be formed from a single rectangular sheet of metal. Opening 30, slot 32 and notch 34 can then be punched out of the metal sheet. As described earlier, the opening, slot and notch are typically aligned with each other along a central longitudinal axis of the sheet; however, the alignment is dependent upon the location of the lances within the cabinet to which the adapters will mount and the user's desired location of the rod that the adapter will receive.

Figure 6:
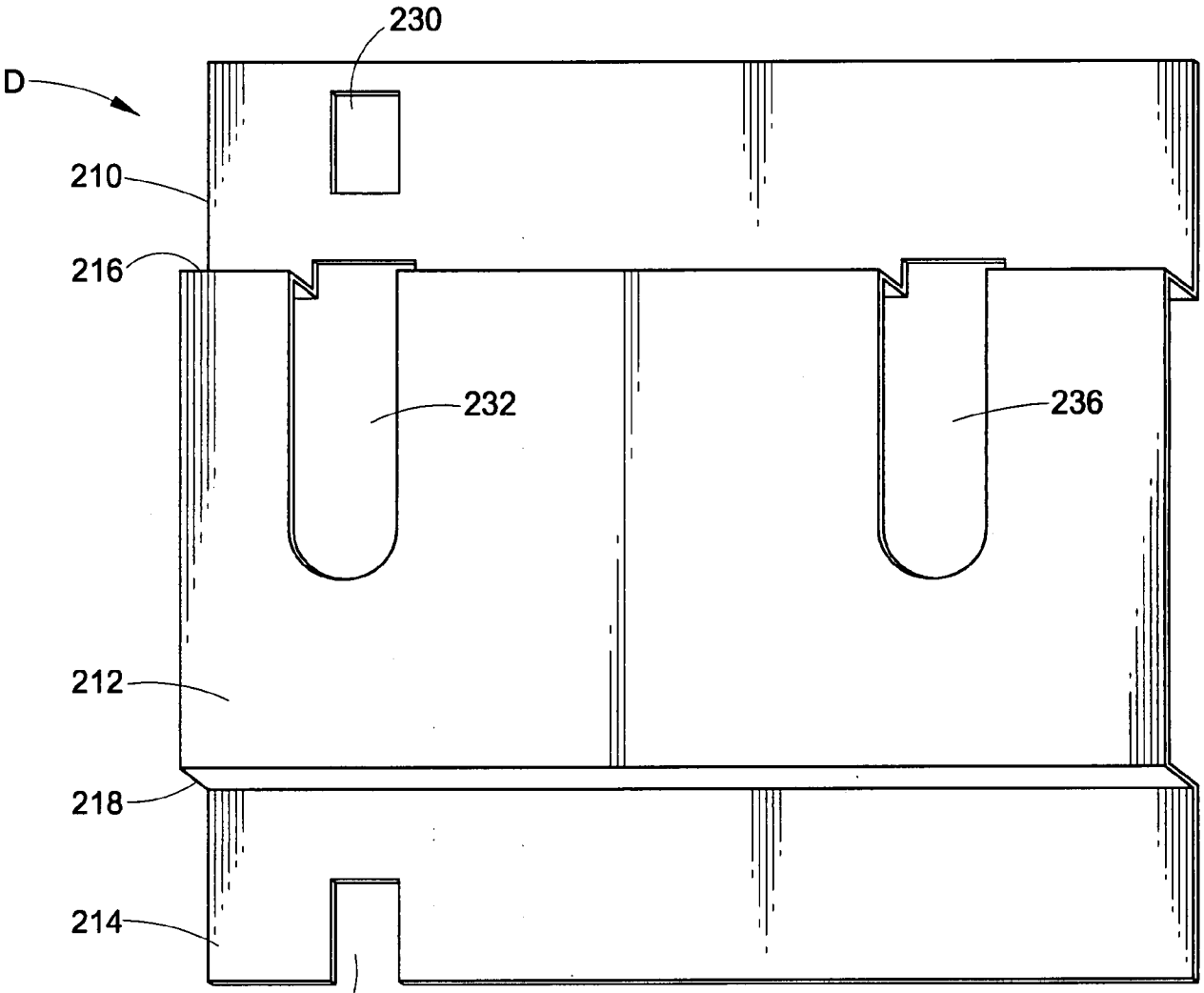
FIG. 6 is a front elevational view of a fourth embodiment of a rod hanger adapter of the present invention; and, FIG. 7 is a perspective view of the rod hanger adapter of FIG. 6.
Figure 7:
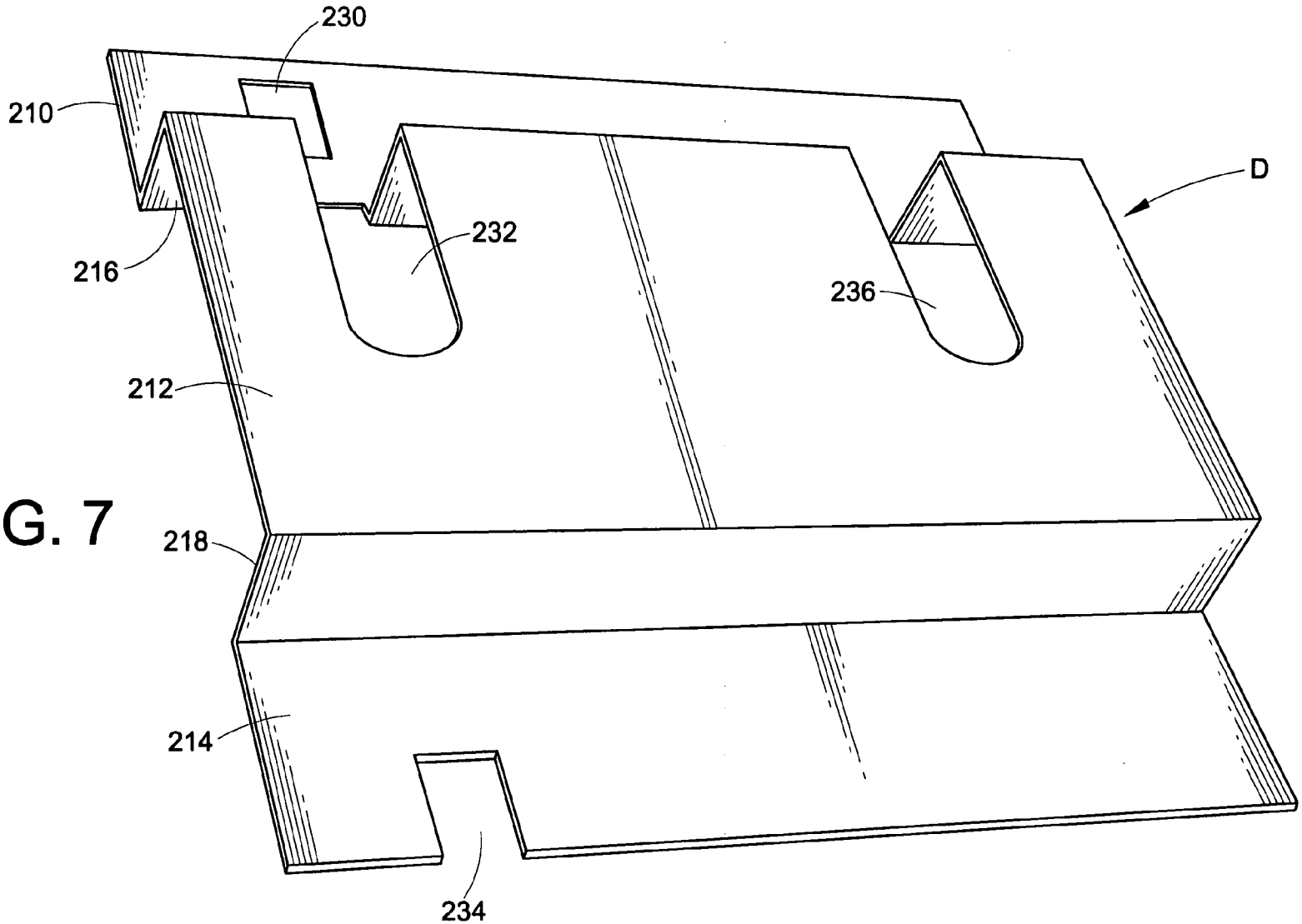

Referring now to FIGS. 6 and 7, another alternative embodiment of a rod hanger adapter D is shown. The rod hanger adapter has first, second and third walls 210, 212, 214, respectively. Wall 212 is spaced from and substantially parallel to walls 210 and 214.

The rod hanger adapter D further includes a fourth wall 216 which interconnects walls 210 and 212 and which is perpendicular to walls 210, 212. A fifth wall 218 interconnects walls 212, 214 and is parallel to wall 216 and substantially perpendicular to walls 212, 214.

Wall 210 includes an opening 230 adapted to receive a lance. The opening may be square, rectangular, or any other shape dependent upon the shape of the lance that it will receive. In this embodiment, the opening 230 is located near an outer edge of the rod hanger adapter D. Wall 214 includes a notch 234 also adapted to receive a lance. Opening 230 and notch 234 are preferably aligned since the corresponding lances that are attached to the cabinet wall are typically aligned with each other; however, the opening 230 and the notch 234 need not be aligned to fall within the scope of the present invention.

Walls 212, 216 each includes a first slot 232 and a second slot 236, both of which are adapted to receive a rod. Slot 232 can be off-center and aligned with each opening 230 and notch 234. Slot 236 is spaced from slot 232 and is located adjacent an opposite edge of the rod hanger adapter D. Obviously, other modifications exist, wherein more slots or more openings and notches can be formed in the rod hanger adapter.

The invention has been described with reference to the preferred embodiments. Obviously, modifications and alterations will occur to others upon reading and understanding the proceeding detailed description. The invention is intended to be construed to include all such modifications and alterations that are obvious to one skilled in the art.

The invention claimed is:

1. A rod hanger adapter, comprising:

a body configured to mount to a side wall of an associated cabinet and receive an associated rod on which items can be hung, wherein the body comprises:

a first wall comprising an opening configured to receive a lance that extends from or is mounted to the side wall of the associated cabinet for mounting the rod hanger adapter to the side wall of the associated cabinet, said opening comprising a linear upper edge and being intersected by a longitudinal axis of said rod hanger adapter;

a second wall spaced from and at least substantially parallel to the first wall, wherein the second wall includes a first portion of a slot configured to receive the associated rod on which items can be hung, said second wall being connected to said first wall, said first portion of said slot being aligned with said opening and being intersected by said longitudinal axis of said rod hanger adapter; and, a third wall connecting said first wall to said second wall, said third wall being substantially perpendicular to said first and second walls, wherein a second portion of said slot extends into said third wall, said second portion of said slot being intersected by said longitudinal axis of said rod hanger adapter.

2. The rod hanger adapter of claim 1, further comprising a fourth wall spaced from and substantially parallel to said second wall, and a fifth wall connecting said second and said fourth wall.

3. The rod hanger adapter of claim 2, wherein the fourth wall includes a notch having a linear upper edge, said notch configured to receive a lance that extends from or is mounted to the side wall of the associated cabinet.

4. The rod hanger adapter of claim 3, wherein the notch is formed in a lower edge of said fourth wall.

5. The rod hanger adapter of claim 4, wherein the notch is aligned with the opening.

6. The rod hanger adapter of claim 1, wherein the adapter is formed from a single piece of metal.

* * * * *